US011141648B1

(12) United States Patent
Giribaldo

(10) Patent No.: US 11,141,648 B1
(45) Date of Patent: Oct. 12, 2021

(54) TRAINING DEVICE FOR CUE SPORTS

(71) Applicant: Joe Giribaldo, Stamford, CT (US)

(72) Inventor: Joe Giribaldo, Stamford, CT (US)

( * ) Notice: Subject to any disclaimer, the term of this patent is extended or adjusted under 35 U.S.C. 154(b) by 0 days.

(21) Appl. No.: 16/535,233

(22) Filed: Aug. 8, 2019

Related U.S. Application Data

(60) Provisional application No. 62/715,831, filed on Aug. 8, 2018.

(51) Int. Cl.
*A63D 15/00* (2006.01)

(52) U.S. Cl.
CPC ..... *A63D 15/006* (2013.01); *A63B 2243/002* (2013.01)

(58) Field of Classification Search
CPC ..... A63D 15/00; A63D 15/10; A63D 15/006; A63F 3/00; A47K 10/42; A63B 69/406; A63B 2243/002; A63B 47/002; A63B 47/02; A63B 47/021; B65D 83/00; G07F 17/3297; G07F 11/42
See application file for complete search history.

(56) References Cited

U.S. PATENT DOCUMENTS 3,033,570 A * 2/1961 Mathes
3,752,651 A * 8/1973 Bush ..... G01N 1/14 436/177
4,254,755 A * 3/1981 Morgan ..... A63B 69/408 124/16
4,268,033 A * 5/1981 Fontaine ..... A63D 15/006 473/2
4,269,441 A * 5/1981 Hirsch ..... E01H 1/12 248/101
4,299,365 A * 11/1981 Battle ..... B65B 67/1238 220/9.2
4,336,939 A * 6/1982 Krumlauf ..... A63F 7/0628 473/183
4,469,328 A * 9/1984 Pacitti ..... A63D 15/005 473/40
4,675,163 A * 6/1987 Mybeck ..... B01L 9/54 141/237
5,056,684 A * 10/1991 Beach ..... F16B 43/00 221/197
5,275,398 A * 1/1994 Compton ..... A63D 15/083 473/2
5,347,707 A * 9/1994 Beach ..... B25B 21/002 29/787
5,376,054 A * 12/1994 Kwasny ..... A63D 15/005 473/40
5,619,977 A * 4/1997 Gatin ..... A63B 69/408 124/16

(Continued)

*Primary Examiner* — Eugene L Kim
*Assistant Examiner* — Christopher Glenn
(74) *Attorney, Agent, or Firm* — Patterson Intellectual Property Law, P.C.; Mark A. Kilgore

(57) ABSTRACT

A training device for positioning balls on the playing surface of cue sport game tables such as billiards, to assist players in making practice shots to enhance their playing skills and techniques. The training device includes a rectangular base, ramps pivotally attached to the rectangular base and pivoted in a deployed position during use, and in a non-deployed position to provide portability, rails provided on the rectangular base and ramps to accommodate object balls of different sizes, and a ball release system for sequentially deploying balls down the ramps in a controlled manner to accurately position the balls on game tables on a consistent basis without having to push each ball by hand.

18 Claims, 7 Drawing Sheets

(56) References Cited

U.S. PATENT DOCUMENTS 5,997,404 A * 12/1999 Sardo ..... A63D 15/005 473/21
7,785,209 B1 * 8/2010 Targosz, Jr. ..... A63D 15/005 473/40
8,025,181 B1 * 9/2011 Horn ..... G07F 13/10 221/226
8,851,780 B1 * 10/2014 Morgan, Jr. ..... A46B 15/0089 401/282
8,864,596 B1 * 10/2014 Maranian
8,911,299 B1 * 12/2014 Day ..... A63D 15/005 473/40
9,539,492 B1 * 1/2017 Eager ..... A63D 15/105
9,616,319 B2 * 4/2017 Geiges ..... A63D 15/005
2005/0101395 A1 * 5/2005 Keating ..... A63D 15/006 473/2
2005/0107176 A1 * 5/2005 Holt ..... A63D 15/006 473/2
2006/0128488 A1 * 6/2006 Pappas ..... A63D 15/006 473/2
2008/0302901 A1 * 12/2008 Wischnowsky ..... A47K 10/28 242/365.7
2011/0201436 A1 * 8/2011 Robinson ..... A63D 15/10 473/42
2012/0112409 A1 * 5/2012 Caron ..... A63F 3/00157 273/144 A
2012/0302361 A1 * 11/2012 Kaplan ..... A63D 15/005 473/40
2014/0086796 A1 * 3/2014 Giraud ..... G01N 35/00029 422/68.1
2014/0357389 A1 * 4/2014 Fischer
2016/0304269 A1 * 10/2016 Erdmann ..... B65D 83/0817
2018/0015356 A1 * 1/2018 Lee ..... A63D 15/105

* cited by examiner

TRAINING DEVICE FOR CUE SPORTS

CROSS-REFERENCE TO RELATED APPLICATIONS

This application claims the benefit of U.S. Provisional Patent Application Ser. No. 62/715,831, filed on Aug. 8, 2018, which is incorporated by reference herein in its entirety.

FIELD OF THE INVENTION

The present invention relates to billiards, and more particularly, to a training device for positioning balls on the playing surface of cue sport game tables, such as billiards or pool, to assist players in making practice shots and further develop their playing skills and techniques.

BACKGROUND OF THE INVENTION

Cue sports are generally played using a game table, balls, and an elongate cue stick that is generally held in a player's hands and maneuvered to forcibly strike the balls along the playing surface of the game table. The game table generally includes a rectangular geometric shape having a specific dimension, a smooth material top surface, and depending on the type of game played, a plurality of pockets situated at designated areas alongside the table for receiving balls during play. Exemplary depictions of cue sports include carom billiards, the well-known game of pool, and snooker which is similar to pool, but comprises a particular game table, and smaller balls. Each respective cue sport is governed by a set of rules and regulations of play defined by game instructions, historical use and culture, and various professional associations and organizations.

Both professional and amateur players alike often practice to further develop their playing skills at the game. One common practice drill entails making repeated cue shots to help improve the player's stance, coordination and shooting techniques over time. The practice drill generally involves positioning a host of object balls at predetermined positions on the playing surface of a cue sport game table, sequentially aligning a cue ball with each positioned object ball, and striking the cue ball forcibly with the distal end of a cue stick forcing the cue ball to collide with each target object ball, directing the object balls into table pockets. The training exercise permits players to strategically place object balls, and the cue ball, at various positions on the playing surface of the cue sport game table in an effort to strategize proper shooting angles, distances, stance, and requisite degree of impact force needed to improve their shooting skills. Individual players must consistently maneuver around the perimeter of the game table when setting up the object balls during a practice session. The need for positioning individual object balls at various locations on the game table is not only time consuming, but also interrupts the player's focus, mental concentration, and pre-shot routine analysis that is often undertaken during practice sessions.

A variety of conventional training devices have been designed in an effort to assist individual players in positioning billiard balls on the playing surface of cue sport game tables. For example, a prior art device includes a ramp having a mechanical clamp that is fastened along the perimeter of a game table where object balls are launched by hand onto the playing surface of the game table. Another prior art device includes a ramp that is placed on the surface of a game table, and is designed to readily hold a single ball at a time where players must apply a forward pushing force by hand on each ball in order to launch the balls down the ramp. Still other training devices include helical ramps, or employ electrical components such as electronic timers and solenoids that are electrically operated to release balls on the surface of a game table.

Conventional cue sport training devices are not without drawbacks. For example, the use of mechanical clamps results in attaching the device at one designated spot along the perimeter of the game table making it cumbersome and difficult to launch balls from different angles on the playing surface of the game table. Constantly loosening and tightening the mechanical clamp is time consuming, and cumbersome. Some prior art devices are specifically designed for use with object balls having a particular size thus restricting use to a particular game. Other training devices are bulky, awkward to use, and are not conveniently portable. Most conventional training aids require players to forcibly launch object balls down a ramp by hand. Those training devices typically provide a less effective means for accurately positioning balls on a playing surface of a table on a consistent basis. For example, as a result of disproportionate forces applied to object balls by a player's hand, it is very difficult to accurately position object balls in desired locations on a game table on a consistent basis. Often times players either drop the object balls onto the ramp with varying degrees of force, or provide a slight, unintentional forward force to the object balls when launching the balls by hand, thus forcing the object balls down the ramp with varying speeds. The forward force applied to object balls is generally proportional to the launching velocity such that a slightly stronger force will result in a faster rolling ball, and a lighter pushing force will result in an object ball rolling slower down a ramp. As a result of the differing forces applied to the object balls by the player's hand when launching object balls, the balls roll down prior device ramps at different velocities and thus into different positions on the game table leading to the inconsistent positioning of balls on the game table.

Accordingly, there is an established need for a training device that is easy to set-up, and use, accommodates use with balls of different sizes, includes a ball release system for selectively positioning balls on the playing surface of cue sport game tables in a controlled manner on a consistent basis, and is small, compact and portable for easily transporting the device to different locations for use with a variety of different cue sport game tables.

SUMMARY OF THE INVENTION

The present invention is directed to a training device for positioning balls on the playing surface of cue sport game tables such as billiards, to assist players in making practice shots. The training device includes a base, ramps pivotally attached to the base which are pivoted in a deployed position, and completely folded in a non-deployed position to provide portability, includes rails to accommodate cue balls of different sizes, and a ball release system including a loading pad and a ball stopper for sequentially deploying balls down the ramps in a controlled manner to accurately position balls on game tables on a consistent basis.

A first embodiment of the invention provides a training device for positioning balls on cue sport game tables, the training device comprising: a rectangular base including a top platform, a pair of base rails extending upwards from lateral edges of the top platform and spaced apart in parallel from each other, a first opening, and a second opening, each opening formed within the top platform and aligned with each other, a ball release system enclosed within the rectangular base and including articulating links operatively coupled to a loading pad, and a ball stopper, where the loading pad is movable vertically within the first opening, and the ball stopper is movable vertically within the second opening, and a pair of ramps pivotally attached to opposite sides of the rectangular base, where the ramps extend forward of the ball stopper when pivoted in a deployed position, and extend parallel with opposite outer side surfaces of the rectangular base when the ramps are folded in a non-deployed position.

In one aspect, the training device further includes a first base stabilizer attached to one side of the rectangular base, and a second base stabilizer attached to another side of the rectangular base opposite the one side.

In another aspect, each ramp includes a triangular shape having a hypotenuse defining a ramp rail for accommodating a rolling ball where a portion of each ramp rail engages each with base stabilizer when the pair of ramps are pivoted about the rectangular base and folded in a non-deployed position.

In one aspect, the articulating links include a first link having an upwardly extending arm, and a second link coupled to the first link and to the ball stopper, where the first and second links are each rotatably enclosed within the rectangular base such that the upwardly extending arm is situated under the loading pad. The first link and the second link each include an opening to receive a link fastener to permit the links to rotate within the rectangular base when a ball is disposed on the loading pad forcing the ball stopper vertically downwards within the second opening to permit another ball to roll engaged against the ball stopper to roll down the ramp rails, where the loading pad and the ball stopper both moving vertically upwards from the first and second opening, respectively, when the ball rolls off the loading pad.

In still another aspect, each base stabilizer includes a first longitudinal edge that is coplanar with the back end of the rectangular base, a second longitudinal edge opposite the first longitudinal edge, and a top lateral edge that extends between the first and second longitudinal edge and inclines towards the back end. A portion of each ramp rail engages the top lateral edge of each base stabilizer when the ramps are folded in a non-deployed position.

In one aspect, each base rail slopes downwards towards the deployed ramps to direct a ball placed on the loading pad to roll forward against the ball stopper. The ball stopper movably extends upwards from the top platform to selectively prevent a ball disposed on the base rails from rolling down the ramps.

In yet another aspect, the rectangular base includes a first body having a ledge including a first cutout, a second cutout, and fastener openings, and a second body having a ledge including a third cutout, a fourth cutout, and fastener openings, where the first body is secured to the second body such that the ledges engage to form the top platform, where the first cutout and the third cutout engage to form the first opening, and where the second cutout and the fourth cutout engage to form the second opening in which the fastener openings align with each other to receive each link fastener.

In one aspect, the training device further includes a lock that selectively prevents the loading pad from moving vertically within the first opening, and the ball stopper from moving vertically within the second opening. The lock includes a slider having a nub where the slider is movable horizontally within slot rails provided within the rectangular base so that the nub releasably engages the loading pad.

In another aspect, a first detent is provided adjacent a top lateral edge of one base stabilizer, and a second detent is provided adjacent another top lateral edge of another base stabilizer, where each detent selectively engages with each of the pair of ramps when the ramps are folded about the rectangular base in a non-deployed position.

These and other objects, features, and advantages of the present disclosure will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Shown throughout the figures, the present invention is directed to a training device for positioning balls on cue sport game tables. The training device includes a base, ramps pivotally attached to the base, a rail system provided on the base and ramps to accommodate balls of different sizes, and a ball release system that includes a loading pad operatively coupled to an articulating system including a first link, a second link, and a ball stopper, where the ball release system is operated to sequentially launch object balls down the ramps and into position on the playing surface of cue sport game tables in a controlled manner on a consistent basis.

Figure 1:
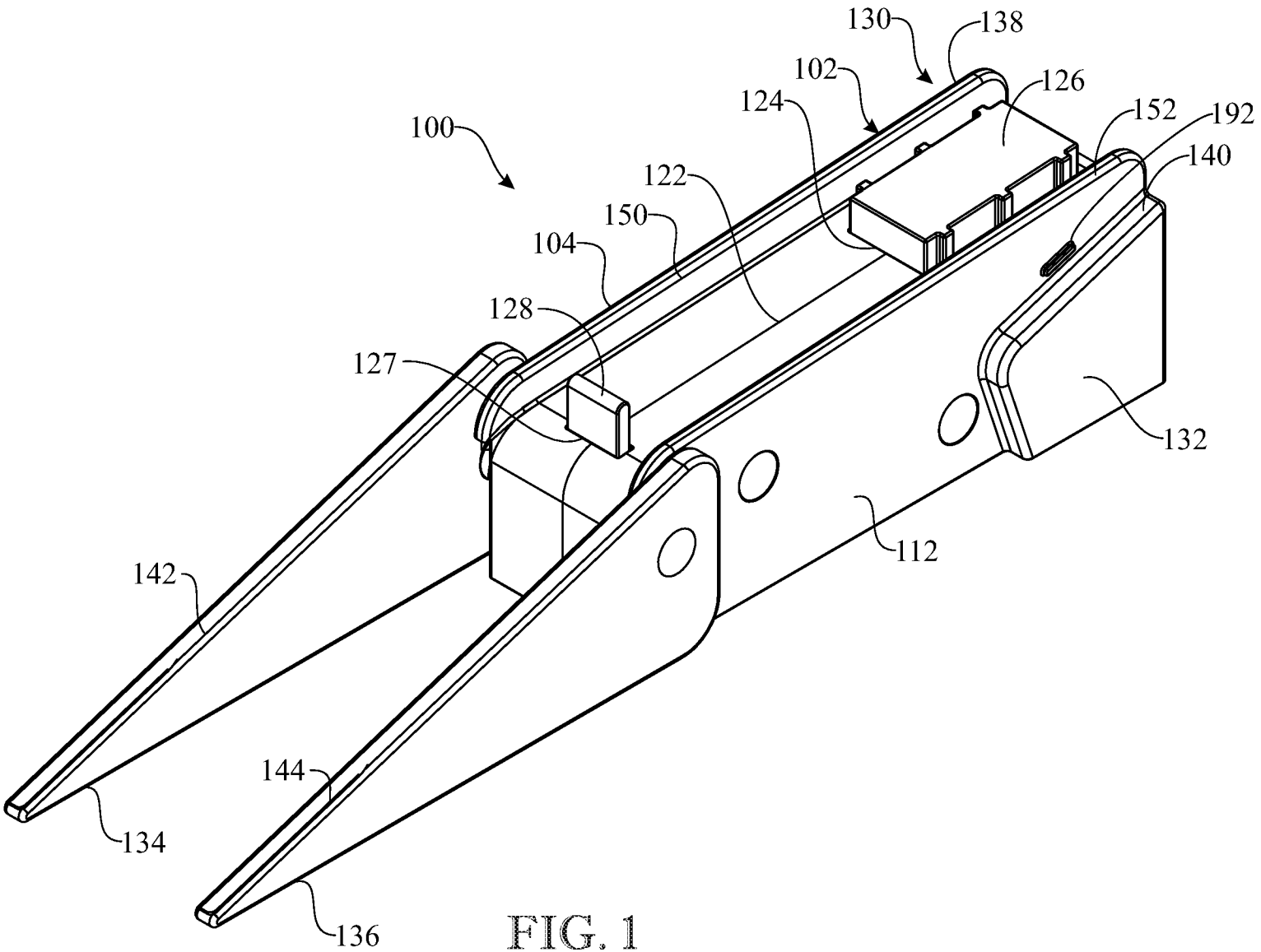
FIG. 1 presents a side perspective view of a training device for cue sports, showing a base including rails, ramps including rails and pivotally attached to the base for deploying object balls of different sizes on cue sport game tables, and a ball release system including a loading pad operatively coupled to a ball stopper for selectively positioning object balls in a controlled manner on game tables, in accordance with one embodiment of the present invention.
Figure 2:
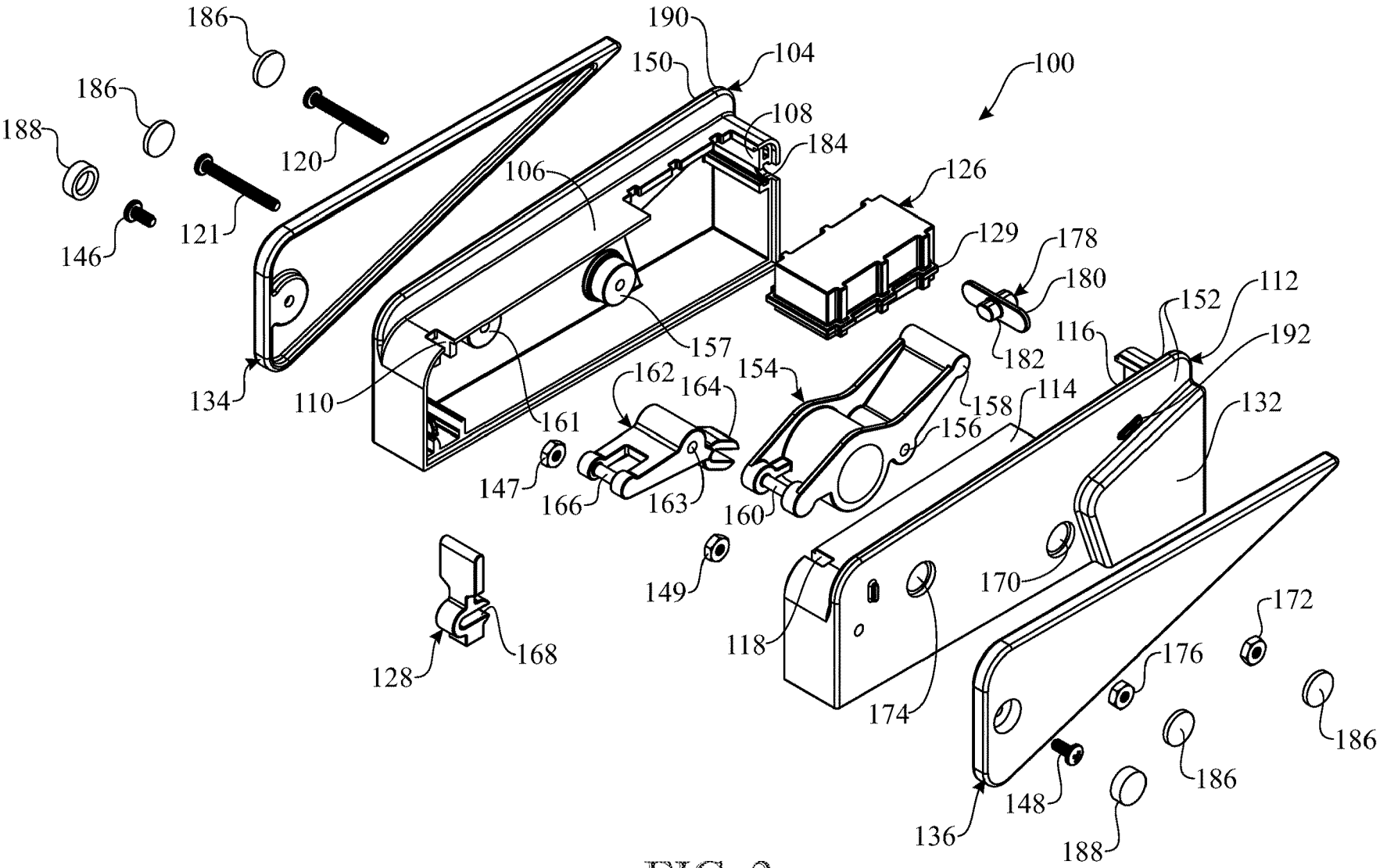
FIG. 2 presents an exploded view of the training device of FIG. 1, showing a plurality of functional parts including ramps, an articulating link system, and integral body parts of the base for readily assembling the training device.

Referring now to the drawings wherein like elements are represented by like numerals throughout, there is shown in FIGS. 1 and 2, a side perspective view, and an exploded view, respectively, of a training device 100 for strategically positioning object balls on the playing surface of cue sport game tables in a controlled manner on a consistent basis during practice shot sessions, via, a cue ball, in accordance with one embodiment of the present invention. Reference made herein to the term, "cue sports", includes, but is not limited to, the game of carom, billiards, pool, and snooker. Also, reference to the term, "object ball", includes one or more balls commonly, known and used for playing billiards or pool that, during play, are impacted by force with a cue ball to move the one or more object balls along the playing surface of such game tables. The training device 100 includes a base 102 defined by a first body 104 including a ledge 106 and cut-outs 108 and 110 formed partially within the ledge 106, and a second body 112 including a ledge 114 and cut-outs 116, 118 also formed partially within the ledge 114. The first and second body 104, 112, respectively, are assembled together via, link fasteners 120, 121 such that the two ledges 106, 114 engage each other to form a top platform 122, and cut-outs 108, 110 engage cut-outs 116, 118, respectively, to form a loading pad opening 124 for receiving a vertically moving loading pad 126, and a stopper opening 127 for receiving a vertically moving ball stopper 128. Each body 104, 112 also includes a base stabilizer 130, 132 that is permanently or releasably secured to opposite outer surfaces of each body 104, 112 and hence the base 102, for securely supporting the base 102 on the playing surface of cue sport game tables. In a preferred embodiment, the base 102 comprises a generally rectangular geometric shape having a predetermined height, width, and length, and may comprise a solid body, a hollow body, or any combination thereof.

Each base stabilizer 130, 132 includes a first longitudinal edge integral with the top lateral edge 138, 140 that is integral with a second longitudinal edge. The second longitudinal edges are each longer in length, and opposite to, each first longitudinal edge. Preferably, each second longitudinal edge is coplanar with the back end of each body 104, 112, or back end of the base 102. The top lateral edge 138, 140 inclines upwards towards the back end of the base 102 at a predetermined angle and length. It is noted that the width of each top lateral edge 138, 140 is defined by the thickness of the material used to construct the base stabilizers 130 and 132. In a preferred embodiment, each top lateral edge 138, 140 spans a width that is equal to, or larger than, the width of each ramp rail 142, 144 of corresponding ramps 134, 136 as shown in FIG. 1. It is appreciated that the base stabilizers 130, 132 may comprise any geometric shape, size, or configuration.

Each body 104, 112 is preferably constructed as one integral part from any durable material, including but not limited to, a dense foam, a hard rubber, a hard polymer, wood, plastic, nylon, any lightweight metal such as aluminum, or any combination thereof, using any well-known process such as injection molding. In one embodiment, the base 102 may include one or more weights or a ballast that is enclosed within, or separately attached to, the body of the base 102 and/or one or both stabilizers 130, 132 to help weight down and secure the cue sport training device 100 in position when disposed on the playing surface of a cue sport game table. The added weight may include a single or multiple pieces of any of metal, lead, ceramic, wood, or include a ballast such as sand or pebbles. For example, small metal plates maybe attached to, or encased within, each stabilizer 130, 132, or base 102 to provide added weight.

With continued reference made to FIGS. 1 and 2, the training device 100 includes a pair of ramps 134, 136 each pivotally attached to opposite sides of the base 102 via, ramp fasteners 146 and 148. Each ramp 134, 136 includes a fastener opening for inserting the ramp fasteners 146, 148 through to pivotally attach the ramps 134, 136 to the sides of the base 102 via, nuts 147 and 149, as illustrated in FIG. 2. In one non-limiting embodiment, ramp fasteners 146, 148 may include screws, a threaded bolt and nut, or a lateral pin or rod that rotatably extends through designated fastener openings formed through the body of each ramp 134, 136, and the base 102. For example, a lateral rod or pin can be firmly retained in place by compressing the opposite ends of the pin or rod, or by use of a mechanical member to prevent the elongate pin or rod from sliding out through formed holes. Alternatively, the articulated, pivoted action of the ramps 134, 136 may be accomplished by a hinge assembly, a tooth gear system, or other suitable articulating or mechanical components. It is contemplated that in one embodiment, ramps 134, 136 move together in parallel, as a single unit. Thus, specific fasteners can be employed to interlock with, or permanently attach to, each ramp 134, 136 to prevent the ramps 134, 136 from pivoting independently from one another about the base 102. One example of such specific fastener may include a bridging element (not shown) such as a webbing or bar that is placed across the ramps 134, 136, at a location that does not restrict object balls from rolling down the ramps 134, and 136. Although a preferred embodiment depicts ramps 134, 136 as being pivotally attached to the base 102, it will be understood that ramps 134, 136 can be releasably attached to opposite sides of base 102, using releasable fasteners such as magnets, hook and loop, snaps, clips, or an interlocking configuration. Thus, the training device 100 includes ramps 134, 136 that are either permanently, or removably, attached to opposite sides of the base 102 using a variety of different connectors or fasteners.

In one non-limiting embodiment, each ramp 134, 136 generally comprises a triangular geometric shape defined by a lateral leg integrally formed with a longitudinal leg, and a hypotenuse that extends from the distal end of the lateral leg to the distal end of the longitudinal leg. In one embodiment, the hypotenuse of each ramp member 134, 136 defines a pair of ramp rails 142, 144 having a top, planar surface comprising a predetermined width that is designed to engage the top lateral edges 138, 140 of each base stabilizer 130, 132, when the ramps 134, 136 are folded, in a non-deployed position, as better illustrated in FIG. 6. The dimensional characteristic of each ramp 134, 136 is selected to permit object balls to roll down the ramp rails 142, 144 by gravity, at a given velocity governed by the angle of each hypotenuse of ramps 134 and 136. It is contemplated that in order to help reduce weight, unwanted material can be removed from the body of each ramp 134, 136 forming openings, gaps, or grooves through the body of each ramp 134, and 136, if desired.

The training device 100 is designed for use with a variety of different cue sport games and includes a rail system for accommodating object balls of different sizes. The rail system includes a pair of ramp rails 142, 144 defined by the hypotenuse of each ramp 134, 136, and a pair of base rails 150, 152 that each extend upwards from opposite lateral edges of the base 102 in parallel with each other. As such, as shown in FIGS. 1 and 2, each ramp rail 142, 144 is integrally formed with respective bodies of each ramp 134, 136, and rails 150, 152 are integrally formed with each first and second body 104, 112 of the base 102. In one non-limiting embodiment, each rail 142, 144, 150, 152 may comprise a flat, planar top, a rounded top edge, or an elongate bar or rod having a predetermined diameter. In one embodiment, each ramp rail 142, 144, and each base rail 150, 152 may include a top, planar edge having a predetermined width that is preselected to accommodate objects balls of different sizes. For example, rails 142, 144, 150, 152 may include a top, planar edge in which the width of the edge is larger to reduce parallel spacing between the rails 142, 144, and 150, 152 for accommodating object balls having smaller diameters, or, alternatively, the width of each top, planar edge of each rail 142, 144, and 150, 152 may be smaller to increase the parallel spacing between the rails 142, 144, and 150, 152 to accommodate object balls having larger diameters. Thus, the training device 100 may be engineered and constructed for use with objects balls of different sizes. In one embodiment, rails 142, 144, 150, 152 may include an adjustable mechanism that permits users to adjust the parallel spacing between the rails 142, 144, 150, 152 to adjust parallel spacing and accommodate use with object balls of different sizes. In one embodiment, a friction material may be coated on, or separately attached to, the top outer surface of each rail 142, 144, 150, 152 to reduce or increase rotational frictional of object balls when rolling on the rails 142, 144, 150, and 152. Such frictional material may include rubber, silicone, lubrication, plastic film, anti-friction coating, anti-friction paint, smooth surface finish, rough surface finish, urethane, epoxy, enamels, or any combination.

Figure 3:
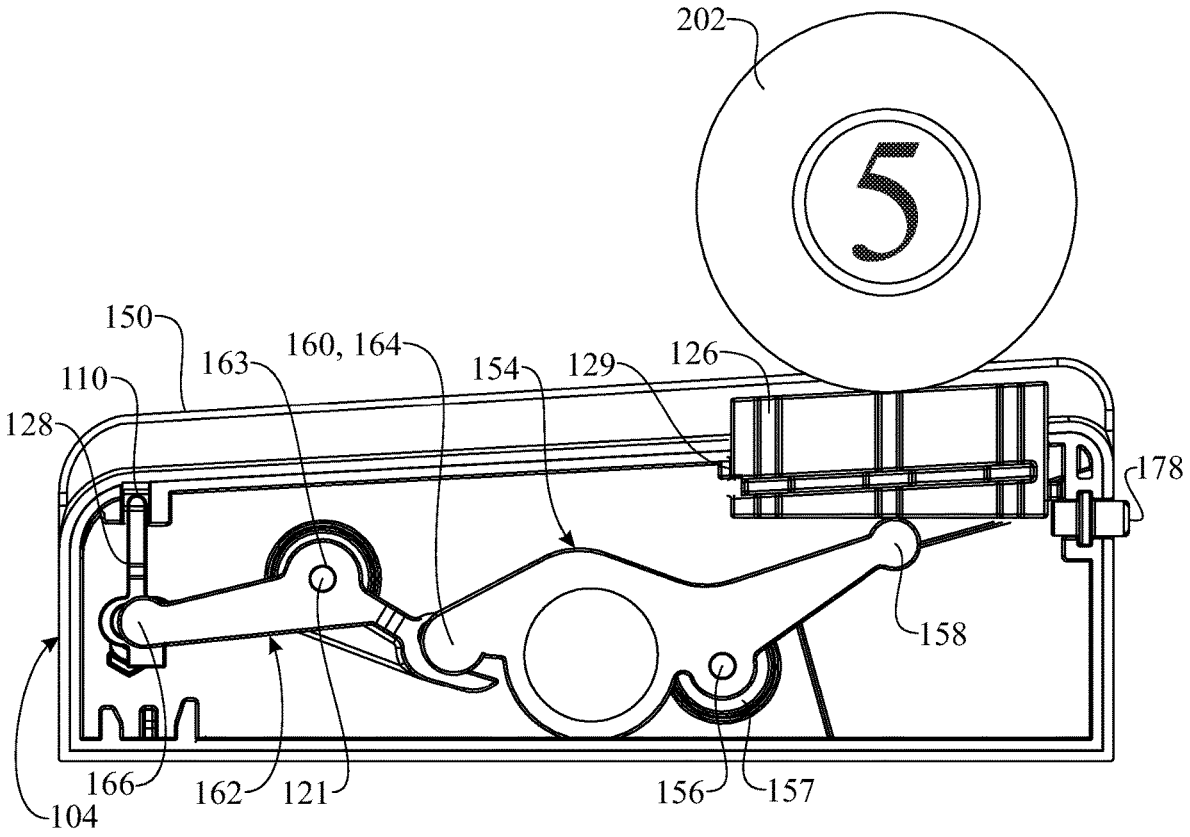
FIG. 3 presents a side perspective view of the training device of FIG. 1 with a second body of the base removed, showing the ball release system including a loading pad, a lock, an articulating link system including a first link mechanically coupled to a second link, and a ball stopper coupled to the distal end of the second link for controllably launching object balls down the ramps.

Turning now to FIGS. 2 and 3, the training device 100 employs a ball release system for providing a controlled method of launching object balls, and assuring accurate and consistent positioning of the object balls on the playing surface of a cue sport game tables during practice. Prior art devices generally require players to apply a forward pushing force by hand to propel object balls down a ramp and onto the top playing surface of game table. As a result of a disproportionate amount of force applied by the player's hand, the object balls roll in different positions on the game table. The applied force is generally proportional to the rolling velocity imparted on the object ball, thus, a faster moving ball will come to rest at a different position on the game table as will a slower moving ball. As such, the present invention assures the accurate placement and positioning of object balls on a game table by implementing the use of a ball release system which eliminates the need of applying a pushing force to launch object balls.

The ball release system includes a first link 154 having a hole 156, an upwardly extending arm 158, and a link post 160, a second link 162 having a hole 163, a link groove 164 and a second link post 166, and a ball stopper 128 including a stopper groove 168. In assembly, the two links 154, 162 attach together such that the link groove 164 of the second link 162 receives the link post 160 of the first link 154, and the stopper groove 168 of the ball stopper 128 receives the second link post 166 of the second link 162. The parts are assembled together and enclosed within the base 102 so that a link fastener 120 extends through the hub 158, through the hole 156 of the first link 154 and through a fastener opening 170 provided in the second body 112. A fastener nut 172 is employed to secure the two bodies 104, 112 together, as better illustrated in FIG. 2. Another link fastener 121 extends through another hub 161, a hole 163 provided in the body of the second link 162, and through a fastener opening 174 provided in the second body 112. A fastener nut 176 secures the two bodies 104, 112 together. As the links 154, 162 are mechanically coupled together within the body of the base 102, the ball stopper 128 is aligned with the ball stopper opening 127 formed by the cut-outs 110 and 118 depicted in FIG. 2, and controllably moves along the vertical axis within the opening 127. It will be understood that the parts comprising the first link 154, the second link 162, the ball stopper 128 and the loading pad 126 may each be constructed from a durable, lightweight material comprising plastic, nylon, or a light metal material.

The loading pad 126 comprises a generally square or rectangular member that includes a peripheral lip 129 for engaging the surrounding perimeter of the loading pad opening 124 when the training device 100 is assembled to prevent the loading pad 126 from exiting the load pad opening 124, as shown in FIG. 3. A friction material or coating may be applied to the upper surface of the loading pad 126 to provide frictional engagement with the surface of an object ball when disposed on the loading pad 126 during use. Such frictional material may include rubber, silicone, dimples, ridges, or grooves. It is appreciated that either the top surface of the loading pad 126, or the base rails 150, 152 may slope slightly downwards towards the front end of the base 102, at a predetermined angle, to direct object balls in a forward direction towards the ball stopper 128 during use.

With continued reference to FIG. 3, a lock 178 is provided at the back end of the base 102 and operated to prevent the loading pad 126 from moving vertically within the loading pad opening 124. In one embodiment, the lock 178 includes a slider 180 having a nub or protrusion 182 extending outwards from the slider 180. The slider 180 slides between slider rails 184 provided on the inner surface of the first and second body 104 and 112, as shown in FIG. 2. The nub 182 may be operated to engage with the peripheral lip 129 of the loading pad 126 or the pad 126 may include a short extension that engages the lock 178. In the present embodiment, the lock 178 slides from left to right to engage and disengage the protrusion 182 with the loading pad 126 to selectively prevent the loading pad 126 from moving vertically. It will be appreciated that other mechanical arrangements may be implemented to provide a lock 178 for selectively preventing the loading pad 126 from moving vertically within the loading pad opening 124 including for example, a push-pull button, a swing lever, or spring detent mechanism.

Upon complete assembly of the parts outlined in FIG. 3, the first body 104 is securely fastened to the second body 112 with link fasteners 120 and 121, and respective fastener nuts 172, 176. As shown in FIG. 3, each fastener opening 170, 174, and fastener openings provided in the ramps 134, 136, include a counter bore to permit the heads of the link fasteners 120, 121, ramp fasteners 146, 148, fastener nuts 172, 176 to enter the counter bore. A series of covers 186, 188 are employed to cover the link fasteners 120, 121, ramp fasteners 146, 148 and nuts 172, 176 to promote the cosmetic appearance of the training device 100. The covers 186, 188 may generally comprise plastic, wood, or metal covers that correspond to the same or different color or pattern of the base 102.

Figure 4:
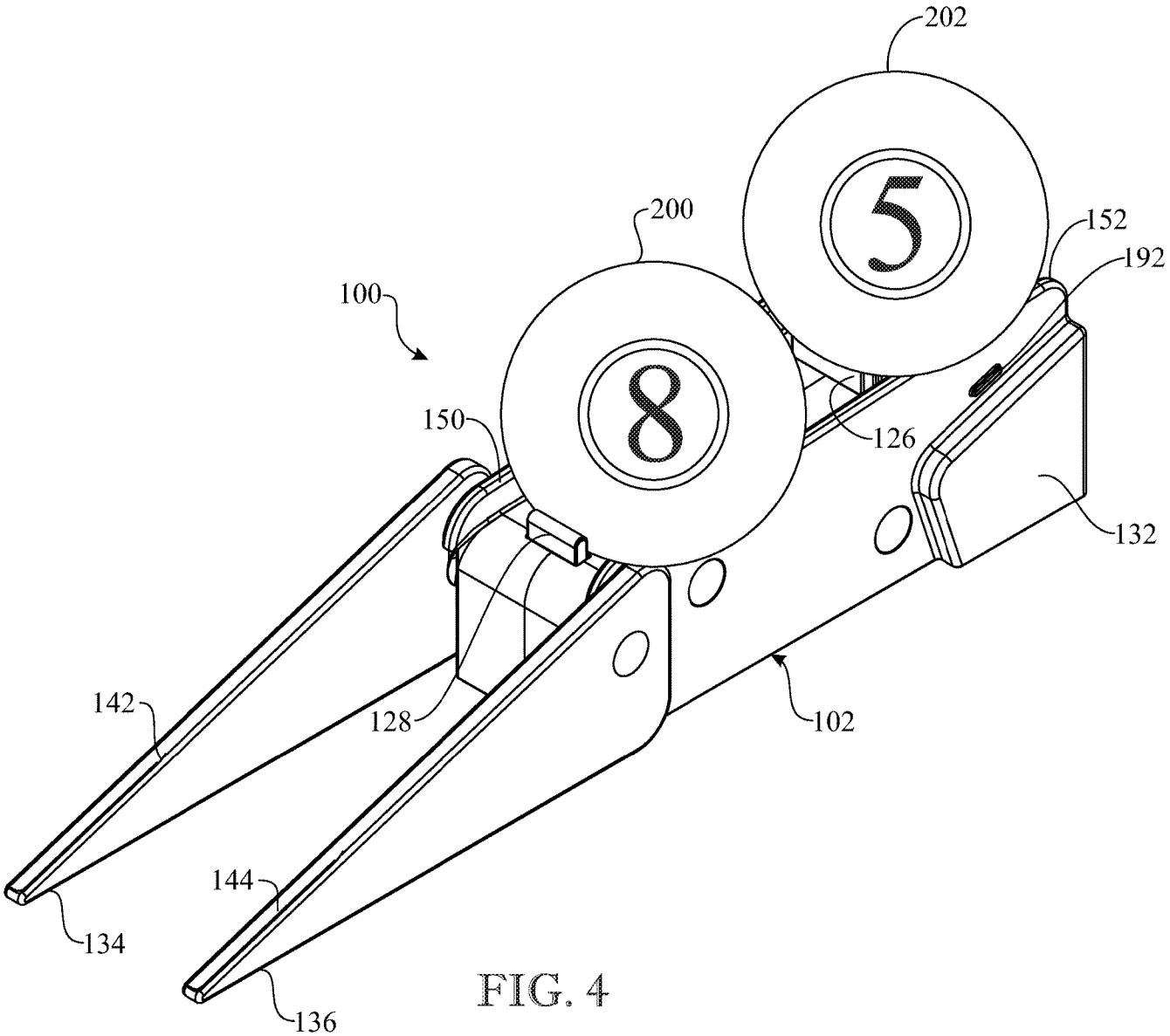
FIG. 4 is a side perspective view of the training device of FIG. 1, showing one object ball resting against the ball stopper for ready deployment down the ramps, and a second object ball readily disposed on the loading pad of the ball release system to lower the ball stopper and launch the one object ball down the ramps by gravity.
Figure 5:
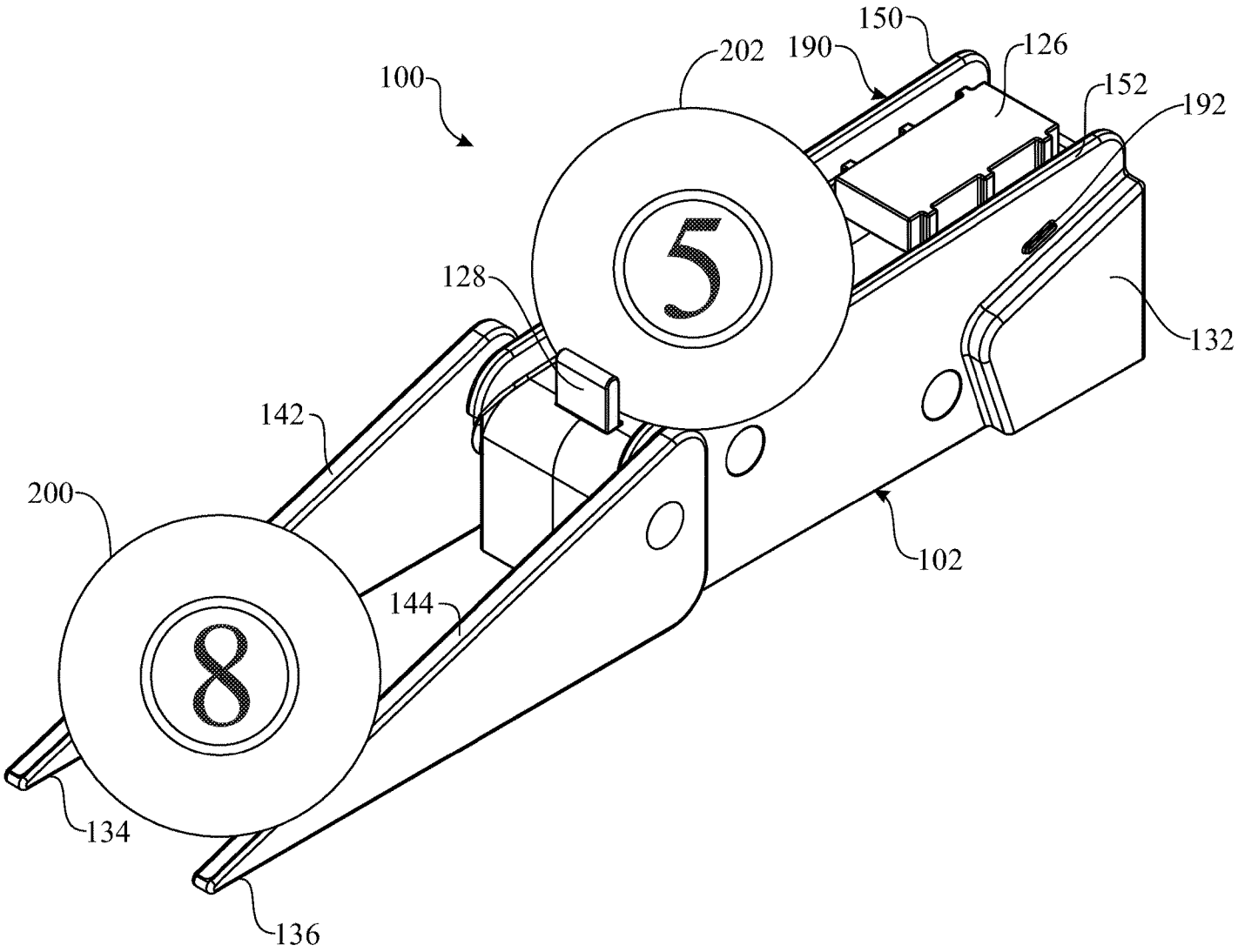
FIG. 5 is a side perspective view of the training device of FIG. 4, showing the one object ball rolling down the ramps in ready position on a cue sport game table, while the second object ball rolls off the loading pad along the base rails and butts against the ball stopper.

Ready deployment of an object ball 200 onto the playing surface of a cue sport game table is better illustrated in reference to FIGS. 2, 4, and 5. With the lock 178 poised in an unlocked position, an object ball 200 is initially positioned on the base rails 150, 152 of the base 102 directly, behind the ball stopper 128. In the illustrative embodiment of FIGS. 4 and 5, the object ball 200 is identified as the number 8 ball associated with a ball in the game of pool. Another object ball 202, denoted as the number 5 ball, is disposed on the loading pad 126 of the ball release system. As shown in FIG. 3, the weight of the object ball 202 forces the loading pad 126 to move vertically, downwards which forces the upwardly extending arm 158 of the first link 154 downwards thus rotating the first link 154 about the link fastener 120 in the opening 156 and moving the link post 160 upwards. As the link post 160 moves upwards, the second link 162 rotates about the link fastener 121 extending through the opening 163 forcing the link post 166 downwards thus moving the ball stopper 126 downwards through the ball stopper opening 127 along a vertical axis, as shown in FIG. 4. Once the ball stopper 126 is completely retracted within the ball stopper opening 127 of the base 102, the barrier preventing the object ball 200 down the ramps 134, 136 is removed, and the object ball 200 is launched down the ramps 134, 136 and rolls along ramp rails 142, 144, as shown in FIG. 5. The second object ball 202 begins to roll in a forward direction off the loading pad 126 towards the front end of the base 102 along base rails 150, 152 where the downward weight of an object ball 202 is removed from the loading pad 126 resulting in the upwardly extending arm 158 moving upwards rotating the first link 154 in an opposite direction and forcing the link post 160 downwards while rotating the second link 162 where the link post 166 begins to move upwards forcing the ball stopper 128 upwards through the ball stopper opening 127 along a vertical axis to extend upwards from the top platform 122 blocking and preventing the object ball 202 from rolling down ramps 134, and 136. As such, as the object ball 202 rolls off the loading platform 126, the ball stopper 128 is uplifted to prevent the object ball 202 from transitioning down the ramps 134, and 136. When ready, the player disposed another object ball on the loading pad 126, forcing the ball stopper 128 downwards allowing the object ball 202 to roll down the ramps 134, 136 coming to rest in positon on the surface of the cue sport game table. The sequence of steps is repeated to sequentially position a plurality of object balls on the playing surface of a game table during a practice session. In circumstances where players do not wish to launch or position an object ball, the player can simply slide the lock 178 into a locking position to prevent the loading pad 126 from moving vertically downwards and articulating the links 154 and 162 to move the ball stopper 128.

Figure 6:
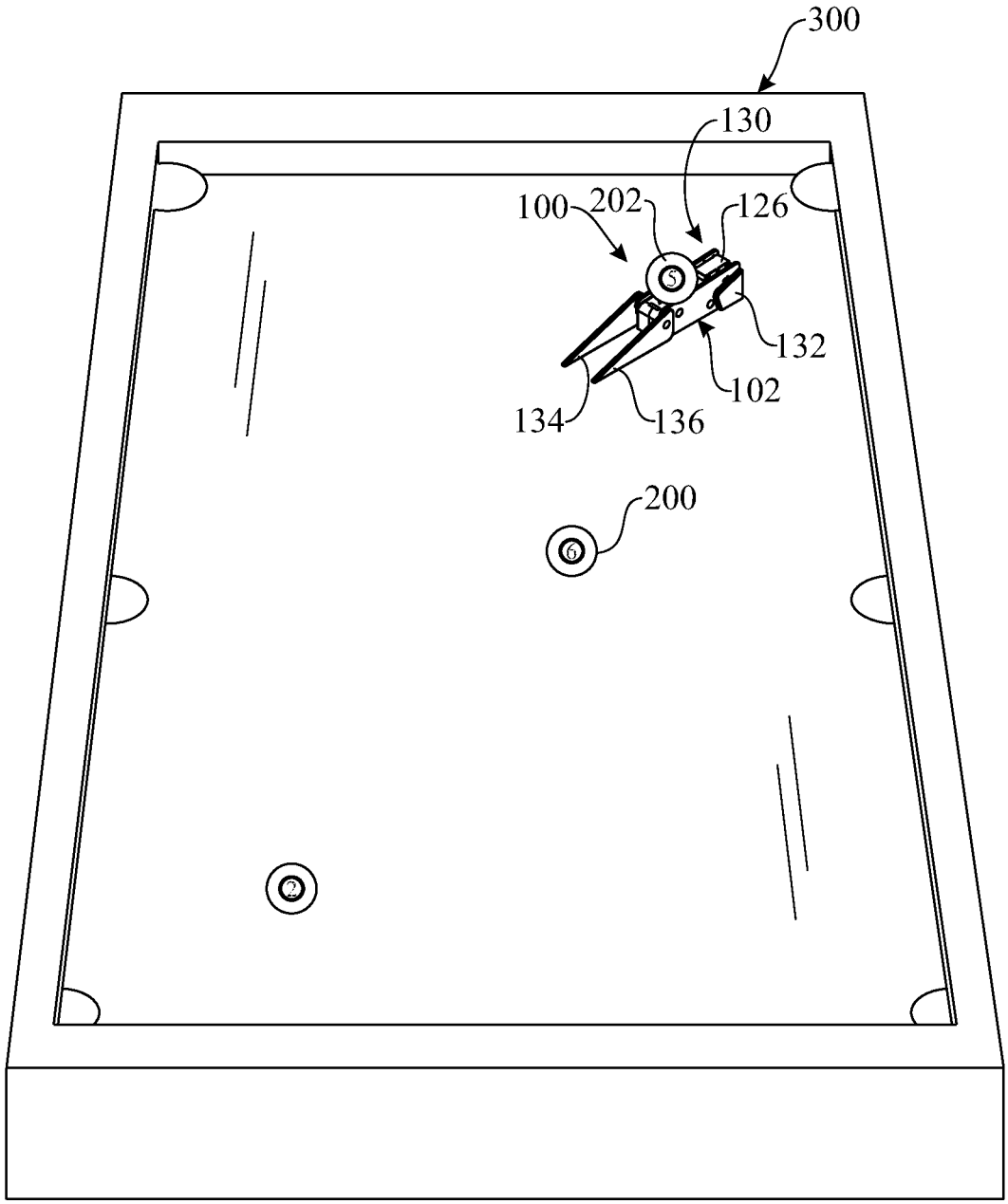
FIG. 6 is a perspective view of the training device of FIG. 1 disposed on the playing surface of cue sport game table, showing object balls deployed in various positions on the cue sport game table in preparation for a practice shot via, a cue ball, and a second object ball poised against the ball stopper for readily rolling down the ramps.

Turning now to FIG. 6 there is shown, a top perspective view of the training device 100 disposed on the playing surface of a cue sport game table 300, with one object ball 202 located on base rails 150, 152 behind the ball stopper 128 for readily launching the ball in position on the game table 300 in preparation for making practice shots; in accordance with one embodiment of the present invention. The training device 100 is employed by individual players during practice sessions to improve their skills and techniques of playing cue sports. During a practice session, the player disposes the training device 100 on the upper playing surface of a cue sport game table 300. In doing so, the base stabilizers 130, 132 provide added stability to properly balance and retain the training device 100 in position. As described with reference to FIGS. 2, 4, and 5, an initial object ball 200 is disposed on the base rails 150, 152, of the base 102, behind the ball stopper 128. Players point the distal ends of the ramps 134, 136 towards the general direction of interest for situating the object ball 200 in position on the table 300. To deploy the object ball 200 down the ramps 134, 136 and into position on the table 300, players dispose a second object ball 202 onto the loading pad 126, as was illustrated in FIGS. 4 and 5. The weight of the object ball 202 forces the loading pad 126 to move downwards forcing the ball stopper 128 vertically downwards allowing the object ball 200 to roll down the ramps 134, 136 by gravity, and into position on the top playing surface of the game table 300, as shown in FIG. 6. As the object ball 200 rolls off the loading pad 126 over base rails 150, 152, the weight of the object ball 200 is removed from the loading pad 126 allowing the ball stopper 128 to move vertically upwards to prevent the previously loaded object ball 202 from rolling down ramps 134, 136, via the ball stopper 128. Players can quickly and easily position the training device 100 at different angles on the table 300, and repeat the sequence of disposing object balls, one at a time, onto the loading pad 126 for positioning balls at different locations on the game table 300 during practice sessions. During practice, players strategically align a cue ball with each object ball positioned placed on the table 300 to make repetitive practice shots while enhancing their playing skills. The simplified construction of the training device 100 includes a ball release system that provides an effective tool for selectively launching object balls down the ramp rails 142, 144 of ramps 134, 136 in a controlled manner to accurately position the object balls on a cue sport game table 300 on a consistent basis during practice sessions, thus eliminating the need for players to apply a pushing force to launch balls down a ramp by hand.

Figure 7:
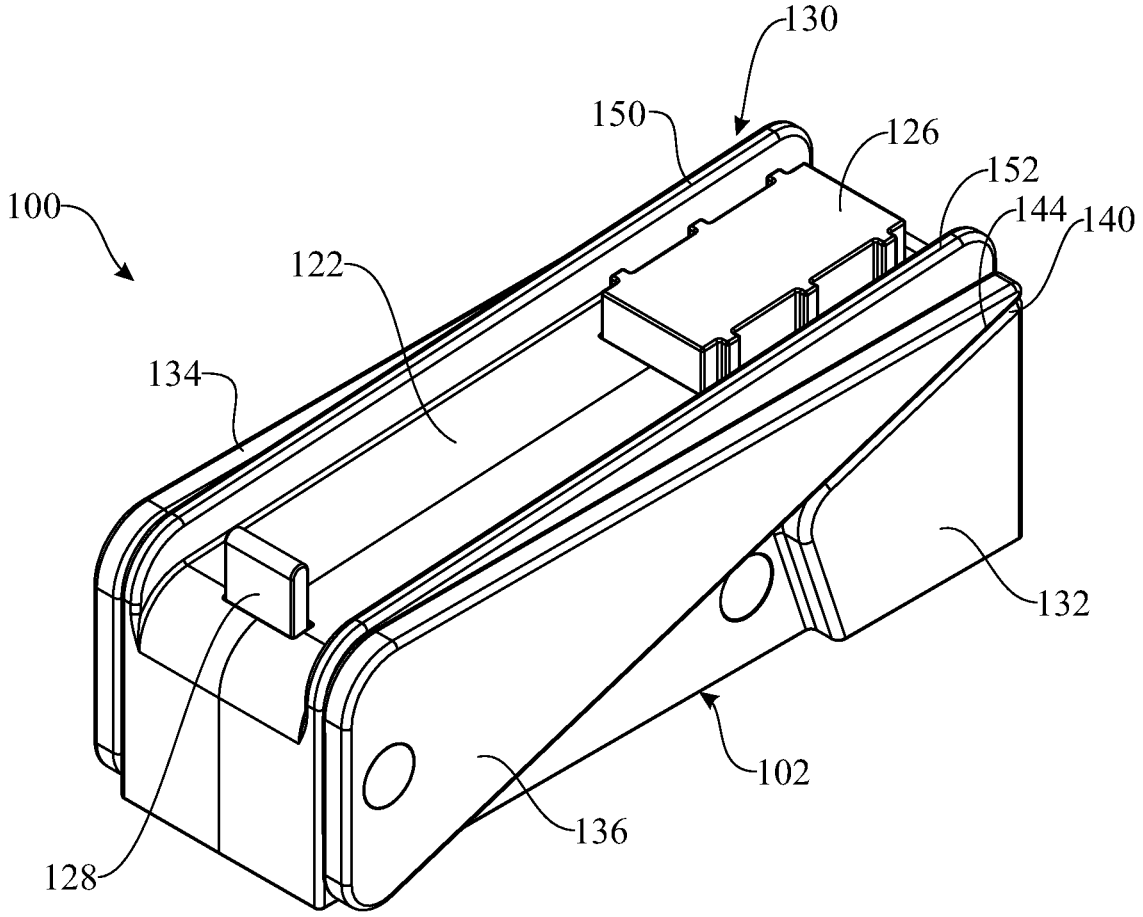
FIG. 7 is a side perspective view of the training device FIG. 1, showing the ramps in a folded, non-deployed position resting on top lateral edges of corresponding base stabilizers for easily transporting and storing the training device.

Referring now to FIG. 7, there is shown a perspective view of the training device of FIG. 1, showing ramps 134, 136 completely folded about the base 102 in a non-deployed position to provide a portable training device 100 that is easily stored in one's pocket, carried and transported for use at different locations or establishments. In one non-limiting embodiment, a pair of detents 190, 192 such as outwardly extending ridges, are provided on opposite sides of the base 102 and oriented slightly above each base stabilizer 130 and 132. Each detent 190, 192 is designed to engage with and securely retain the ramps 134, 136 in a fully folded, pivoted position such that the top, planar rail 142, 144 of each ramp 134, 136, respectively, engages the top lateral edges 138, 140 of each base stabilizer 130, and 132. The inclined surface of the top lateral edges 138, 140 corresponds to a portion of respective hypotenuse of each ramp 134, 136 providing for smooth engagement of the ramps 134, 136 with respective base stabilizers 130, 132. When the ramps 134, 136 are fully folded and pivoted in a closed, non-deployed position, the training device 100 assumes a generally, rectangular shape to more easily store the training device in a player's pocket. It will be understood that detents 190, 192 may comprise rounded members shaped as a semi-sphere, generally constructed from a plastic or smooth nylon material, or include a spring or bias member for providing spring-detents that resiliently extend outwards, away from the base 102. Each detent 190, 192 may correspondingly engage with, and releasably extend within, detent holds formed at designated areas within the inner surface of each ramp 134 and 136. In one non-limiting embodiment, the detent holds may each comprise a hole, or bore, ridge, groove, protrusion, catch, or indentation provided at predetermined locations within the inner surface of ramp members 134, and 136, It will be appreciated that additional detents may also be employed to releasably lock the ramps 134, 136 in place, in a fully open, deployed position.

The cue sport training device 100 is designed for use with a host of different cue sport games including carom, pool, billiards, or snooker, and is easy to use when positioning object balls at various locations on the playing surface of game tables to assist players in making repetitive practice shots without hindering the positional stance, concentration level, and coordination undertaken during practice sessions. The ramps 134, 136 are pivoted about the base 102 into a fully deployed position where the ramps 134, 136 extend forwards in front of the ball stopper 128, or are fully folded about the base 102 to rest on base stabilizers 130, 132 when in a non-deployed position to provide portability. The cue sport training device 100 may include any color, pattern, design, logo, advertisement, or indicia.

Since many modifications, variations, and changes in detail can be made to the described preferred embodiments of the invention, it is intended that all matters in the foregoing description and shown in the accompanying drawings be interpreted as illustrative and not in a limiting sense. Furthermore, it is understood that any of the features presented in the embodiments may be integrated into any of the other embodiments unless explicitly stated otherwise. The scope of the invention should be determined by the appended claims and their legal equivalents.

What is claimed is:

1. A training device for positioning balls on cue sport game tables, said training device comprising:

a rectangular base including a top platform, a pair of base rails extending upwards from lateral edges of said top platform and spaced apart in parallel from each other, a first opening, and a second opening, each opening formed within said top platform and aligned with each other;

a ball release system enclosed within said rectangular base and including articulating links operatively coupled to a loading pad, and a ball stopper, said loading pad movable vertically within said first opening, and said ball stopper movable vertically within said second opening;

a pair of ramps pivotally attached to opposite sides of said rectangular base, said ramps extending forward of said ball stopper when pivoted in a deployed position and extending parallel with opposite outer side surfaces of said rectangular base when pivoted in a non-deployed position; and a lock that selectively prevents said loading pad from moving vertically within said first opening, said lock includes a slider having a nub, said slider moveable horizontally within slot rails provided within said rectangular base so that said nub releasably engages said loading pad.

2. The training device of claim 1, further including a first base stabilizer attached to one side of said rectangular base, and a second base stabilizer attached to another side of said rectangular base opposite said one side.

3. The training device of claim 2, wherein each of said pair of ramps includes a triangular shape having a hypotenuse defining a ramp rail for accommodating a rolling ball.

4. The training device of claim 3, wherein a portion of each ramp rail engages each of said base stabilizers when said pair of ramps are pivoted about said rectangular base and folded in said non-deployed position.

5. The training device of claim 4, wherein said articulating links include a first link having an upwardly extending arm, and a second link coupled to said first link and to said ball stopper, said first and second link rotatably enclosed within said rectangular base such that said upwardly extending arm is situated under said loading pad.

6. The training device of claim 5, wherein said first link and said second link each include an opening receiving a link fastener to permit said links to rotate within said rectangular base when a ball is disposed on said loading pad forcing said ball stopper vertically downwards within said second opening to permit another ball to roll down said ramp rails, said loading pad and said ball stopper both moving vertically upwards from said first and second opening, respectively, when said ball is removed from said loading pad.

7. The training device of claim 6, wherein each of said base stabilizers includes a first longitudinal edge that is coplanar with said back end of said rectangular base, a second longitudinal edge opposite said first longitudinal edge, and a top lateral edge that extends between said first and second longitudinal edge and inclines towards said back end.

8. The training device of claim 7, wherein said portion of each ramp rail engages said top lateral edge of each base stabilizer when said ramps are folded in said non-deployed position.

9. The training device of claim 6, wherein each of said base rails slope downwards towards said deployed ramps to direct a ball placed on said loading pad to rest against said ball stopper.

10. The training device of claim 6, wherein said ball stopper movably extends upwards from said top platform to selectively prevent a ball disposed on said base rails from rolling down said ramps.

11. The training device of claim 6, wherein said loading pad includes a peripheral lip that engages a perimeter of said first opening preventing said loading pad from falling out of said first opening.

12. The training device of claim 6, wherein said rectangular base includes a first body having a ledge including a first cutout, a second cutout, and fastener openings, and a second body having a ledge including a third cutout, a fourth cutout, and fastener openings, said first body secured to said second body such that said ledges engage together to form said top platform, said first cutout and said third cutout engage to form said first opening, and said second cutout and said fourth cutout engage to form said second opening, said fastener openings aligned with each other to receive each of said link fastener.

13. The training device of claim 10, wherein each of said pair of ramps includes a fastener opening for receiving a ramp fastener.

14. The training device of claim 13, wherein each fastener opening includes a counter bore for receiving heads of said fasteners and fastener nuts.

15. The training device of claim 14, further including covers for covering one or more of said counter bores.

16. The training device of claim 8, further including a first detent provided adjacent a top lateral edge of one base stabilizer, and a second detent provided adjacent another top lateral edge of another base stabilizer, each of said detents selectively engaging with each of said pair of ramps when said ramps are folded about said rectangular base in a non-deployed position.

17. A training device for sequentially positioning balls on cue sport game tables, said training device comprising:

a rectangular base including a top platform, a pair of rails extending upwards from lateral edges of said top platform and spaced apart in parallel from each other, a first opening, and a second opening, each opening formed within said top platform and aligned with each other;

a ball release system enclosed within said rectangular base and including articulating links operatively coupled to a loading pad, and a ball stopper, said loading pad movable vertically within said first opening, and said ball stopper movable vertically within said second opening;

a pair of ramps pivotally attached to opposite sides of said rectangular base, said ramps extending forward of said ball stopper when pivoted in a deployed position and extending parallel with opposite outer side surfaces of said rectangular base when in a non-deployed position;

a first base stabilizer attached to one side of said rectangular base, and a second base stabilizer attached to another side of said rectangular base opposite said one side; and a lock that selectively prevents said loading pad from moving vertically within said first opening, said lock includes a slider having a nub, said slider moveable horizontally within slot rails provided within said rectangular base so that said nub releasably engages said loading pad.

18. A training device for sequentially positioning balls on cue sport game tables, said training device comprising:

a rectangular base including a top platform, a pair of rails extending upwards from lateral edges of said top platform and spaced apart in parallel from each other, a first opening, and a second opening, each opening formed within said top platform and aligned with each other;

a ball release system enclosed within said rectangular base and including articulating links operatively coupled to a loading pad, and a ball stopper, said loading pad movable vertically within said first opening, and said ball stopper movable vertically within said second opening;

a pair of ramps pivotally attached to opposite sides of said rectangular base, said ramps extending forward of said ball stopper when pivoted in a deployed position and extending parallel with opposite outer side surfaces of said rectangular base when in a non-deployed position;

a lock provided on said rectangular base for selectively preventing said loading pad from moving vertically within said first opening;

a first base stabilizer attached to one side of said rectangular base, and a second base stabilizer attached to another side of said rectangular base opposite said one side; and a lock that selectively prevents said loading pad from moving vertically within said first opening, said lock includes a slider having a nub, said slider moveable horizontally within slot rails provided within said rectangular base so that said nub releasably engages said loading pad.

* * * * *